US007191789B2

(12) United States Patent
Corbett, Jr.

(10) Patent No.: US 7,191,789 B2
(45) Date of Patent: Mar. 20, 2007

(54) TRANSITION ADAPTOR AND COMPONENT MODULES FOR HYDRONIC HEATING

(75) Inventor: A. Hoyt Corbett, Jr., Bainbridge Island, WA (US)

(73) Assignee: Inventive Development L.L.C., Bainbridge Island, WA (US)

( * ) Notice: Subject to any disclaimer, the term of this patent is extended or adjusted under 35 U.S.C. 154(b) by 294 days.

(21) Appl. No.: 10/837,215

(22) Filed: Apr. 30, 2004

(65) Prior Publication Data

US 2004/0216784 A1 Nov. 4, 2004

Related U.S. Application Data

(60) Provisional application No. 60/467,433, filed on May 2, 2003.

(51) Int. Cl.
*F24D 3/10* (2006.01)

(52) U.S. Cl. ..... 137/15.01; 137/599.14; 237/69

(58) Field of Classification Search ..... 137/599.11, 137/599.14, 15.01; 237/69
See application file for complete search history.

(56) References Cited

U.S. PATENT DOCUMENTS 2,823,695 A * 2/1958 Coffin ..... 137/337
2,878,651 A * 3/1959 Heinzelman ..... 62/235
4,770,341 A * 9/1988 Drake ..... 237/69
4,907,739 A 3/1990 Drake
5,022,459 A * 6/1991 Chiles et al. ..... 165/11.1
5,111,875 A * 5/1992 Hammarstedt ..... 165/50
5,390,660 A 2/1995 Danielson
6,345,770 B1 * 2/2002 Simensen ..... 237/69
6,347,748 B1 * 2/2002 Lyons ..... 237/69

* cited by examiner

*Primary Examiner*—Stephen M. Hepperle
(74) *Attorney, Agent, or Firm*—Graybeal Jackson Haley LLP

(57) ABSTRACT

A system for making modular all of the components of hydronic heating systems so that they can be assembled in various configurations with a minimum of error and labor. The system includes a modular transition adaptor that completes a first hydronic loop and provides a supply outlet and return inlet for servicing a second hydronic loop which is dependent from the first. The transition adaptor has standard spacing and fittings for simple and error free connection to other components such as boilers and mechanical modules. The system also includes a modular supply-return connector that can be connected to the branch outlet and branch inlet of the transition adaptor and to other supply-return connectors. Each supply-return connector includes further branches to provide heated liquid to hydronic radiator loops. The supply-return connectors may include pumps or valves.

13 Claims, 10 Drawing Sheets

1

6
6
3

4
2
5

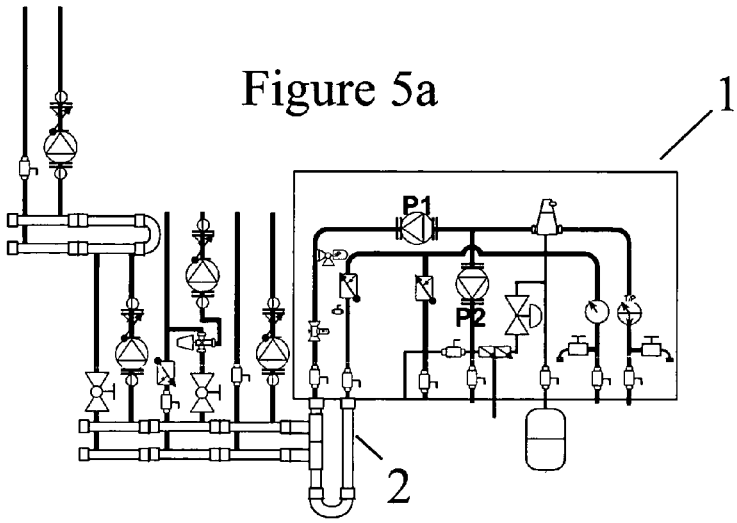
Transition Adaptor systematically assembled with Secondary Component Modules
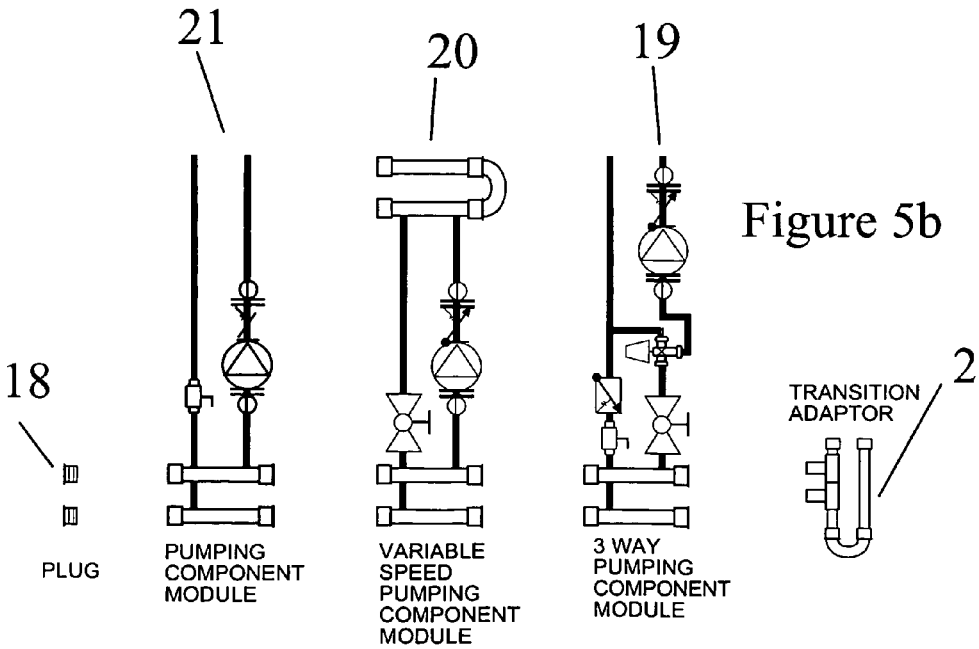

Figure 6a
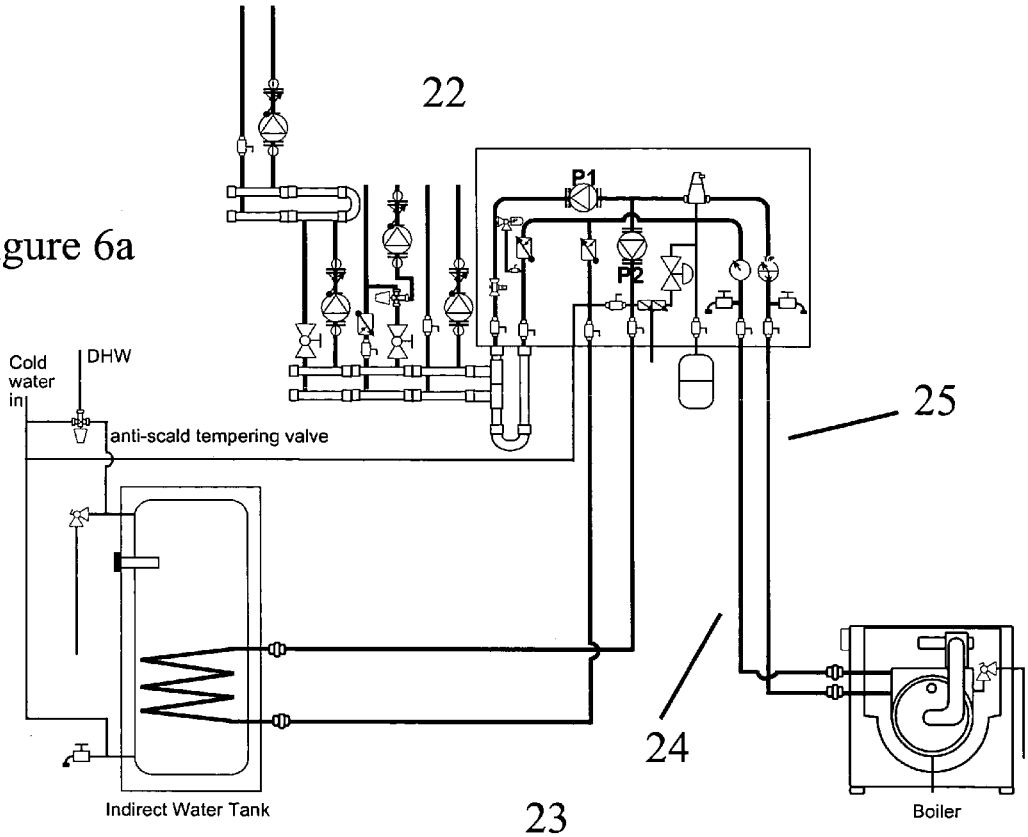
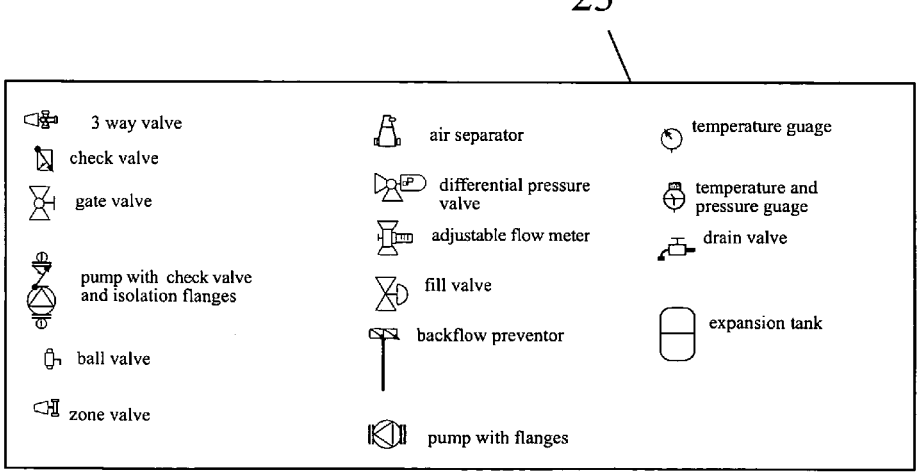
Figure 6b

TRANSITION ADAPTOR AND COMPONENT MODULES FOR HYDRONIC HEATING

This application claims priority from provisional patent application No. 60/467,433, filed May 2, 2003, which is incorporated herein by reference.

BACKGROUND

Hydronic heating systems typically include many final heating loops, each of which is adjustable for rate of flow to increase or decrease heat delivered. For optimal performance of pumps and the motors that drive them, it is preferred that each hydronic loop, whether coming directly from the boiler or a sub-loop, not be subjected to a widely varying range of resistance. Consequently, it is common practice to start with a primary loop from the boiler which is driven by a pump, or sometimes convection. The primary loop has low enough resistance to maintain good flow. Tapping off of the primary loop are several secondary loops, each with its own pump that may be turned on and off or varied in speed. Each secondary loop draws hot liquid from a secondary outlet off the primary loop and injects return liquid through a secondary inlet to the primary loop, typically closely spaced and downstream of the secondary outlet to provide good hydraulic separation of the loops. Thus, the pump or convective force which drives the primary loop experiences relatively constant flow resistance whether the pump for any secondary loop is on or off. The inlet and outlet for a secondary loop should be placed on the primary loop no more than 4 pipe diameters, center to center, away from each other to prevent a pressure differential due to friction loss in the primary loop between the inlet and outlet. Such a pressure differential would cause flow to be induced in the secondary loop even if its pump were not running.

Each secondary loop typically flows through the final delivery radiator system. Alternatively, there can be a tertiary loop drawing off a secondary loop where the tertiary loop directs the liquid through the radiator system. In this case, the second loop might be called an "intermediate" loop while the third loop is called a "secondary" loop. When a loop farther from the heat source taps into a loop closer to the heat source, the closer loop may be called a "main" loop and the farther loop may be called "branch" loop, whether the connection is between a first loop and a second loop or between a second loop and a third loop, etc.

Although it is known to combine many components that are used between a boiler and the secondary loops into a mechanical module, there are no modular components for making the connections between the boiler and such a mechanical module or between the mechanical module and the secondary loops that make a complete and flexible system. Preassembling hydronic mechanical modules with many of the normally utilized mechanical parts (for example, but not limited to, pumps, valves, expansion tanks, check valves, etc.) has been attempted in the past, but has been unsatisfactory, since many of the required additional primary, intermediate and secondary components have been required to be field installed, often sweated in place or field fabricated resulting in many errors, poor practice, poor hydronic design, and has been very labor intensive. Thus, a way to facilitate more foolproof and effective practice is needed.

Mechanical modules with integral adaptors or modular transition adaptors for mechanical modules that facilitate the use of primary, secondary, and intermediate component modules in a systematic way would be a significant improvement. Primary, secondary and intermediate component modules that will systematically attach to the transition adaptor will allow for manufactured assembly and easy connection of primary, secondary and intermediate component modules, reducing installation errors, time and often cost.

SUMMARY OF THE INVENTION

The invention is a system for making modular all of the components of hydronic heating systems so that they can be assembled in various configurations with a minimum of error and labor.

In one aspect, the invention is a preassembled section of pipe for forming a main loop where the pipe includes necessary bends and has branch outlets and inlets that are side-by-side in fixed relation to each other at a standard distance between them so that other modular hydronic components can easily be connected. This main loop pipe has a main inlet, a branch outlet, a branch inlet, and a main outlet. It may include other components such as a pump or other elements of a mechanical module or an entire mechanical module. If no other components are included, it is simply a u-shaped or circular shaped pipe that turns 180 degrees between its main inlet and its main outlet and has somewhere along its length a branch outlet and a branch inlet which are side-by-side adapted to fit with other modular hydronic components. The branch outlet and branch inlet should be no more than 4 pipe diameters apart so that they do not have significantly different hydraulic pressures when the system is running.

In one embodiment, the main inlet and the main outlet are also side-by-side in fixed relation to each other at a set distance with connection fittings adapted to be fitted to other modular hydronic components. The distance must be large enough to work the fittings for each end of the pipe, at least about 2 inches center to center, but short enough to provide a convenient and organized modular system, about 12 inches center to center. Preferred spacing is 3 to 4 inches center to center.

If the inlets and outlets of boilers and mechanical modules are made at the appropriate distance apart with the appropriate standard fittings, the transition adaptor can be used to complete a primary loop from the boiler. Similarly, if the connectors from a mechanical module are made with the appropriate spacing and connection fittings, the transition adaptor can complete the loop from the mechanical module (which might be a primary loop or an intermediate loop) to make the connection to the secondary (or tertiary) loops.

In another aspect, the invention is a modular supply-return connector which is adapted for connection to the transition adaptor and for connection to other compatible supply-return connectors. The modular supply-return connector consists of a supply chamber and a return chamber coupled together to hold all of the inlets and outlets in appropriate relationship to each other for easy connection to other modular hydronic heating components. The supply chamber has a main inlet, a main outlet, and a branch outlet. The return chamber has a main inlet, a main outlet, and a branch inlet. Several of the supply-return connectors can be coupled together to form a functional unit that may be described as a manifold.

An important aspect of the supply-return connector is that the branch inlets and branch outlets have appropriate spacing for coupling to other hydronic modular secondary components. The secondary components, typically consisting of pumps and valves, are physically large enough that, if the piping to and from them runs straight in an organized way, the distances center to center from a branch inlet to each of the adjacent branch outlets should be at least one and one-half inches, preferably about four inches. With four inch preferred spacing, the preferred length of each supply return connector is eight inches, although, for some applications, it could be as small as three inches or longer than 20 inches.

Just as the transition adapter can be incorporated into a larger module such as a mechanical module, the supply return connector can be incorporated with secondary components consisting of pumps and valves and the like to further reduce labor required at installation time and minimize the number of possible errors.

A simple and inexpensive way to make the supply-return adaptor is to use sections of metal pipe and braze or weld or solder them together. Because a branch pipe going from a main supply line or return line must pass the other main line, it can serve as the structure which holds the two main lines in fixed relationship to each other. This can be accomplished by using a smaller diameter pipe for the branch pipe and passing it through the main supply pipe or return pipe without creating a communicating hole between them. This allows the center of the branch pipe to be in the same plane as the center of the supply and return pipes, which achieves a preferred installation layout and organization.

BRIEF DESCRIPTION OF THE DRAWINGS

The features of the present invention which are believed to be novel are set forth with particularity in the appended claims. Aspects of the invention may best be understood by making reference to the following description taken in conjunction with the accompanying drawings wherein:

FIG. 5*a* shows an assembled system with mechanical modular, transition adaptor, and three secondary component modules having integrated supply-return connectors.

FIG. 5*b* shows individual secondary component modules having integrated supply return connectors.

FIG. 6*a* shows a completed system with a boiler and an indirect water tank, including an anti-scald tempering valve.

FIG. 6*b* is a key for schematic symbols.

DETAILED DESCRIPTION

In the following detailed description of exemplary embodiments of the invention, reference is made to the accompanying drawings. The detailed description and the drawings illustrate specific exemplary embodiments by which the invention may be practiced. Other embodiments may be utilized, and other changes may be made, without departing from the spirit or scope of the present invention. The following detailed description is therefore not to be taken in a limiting sense, and the scope of the present invention is defined by the stated claims.

Figures 1A, 1B, 1C:
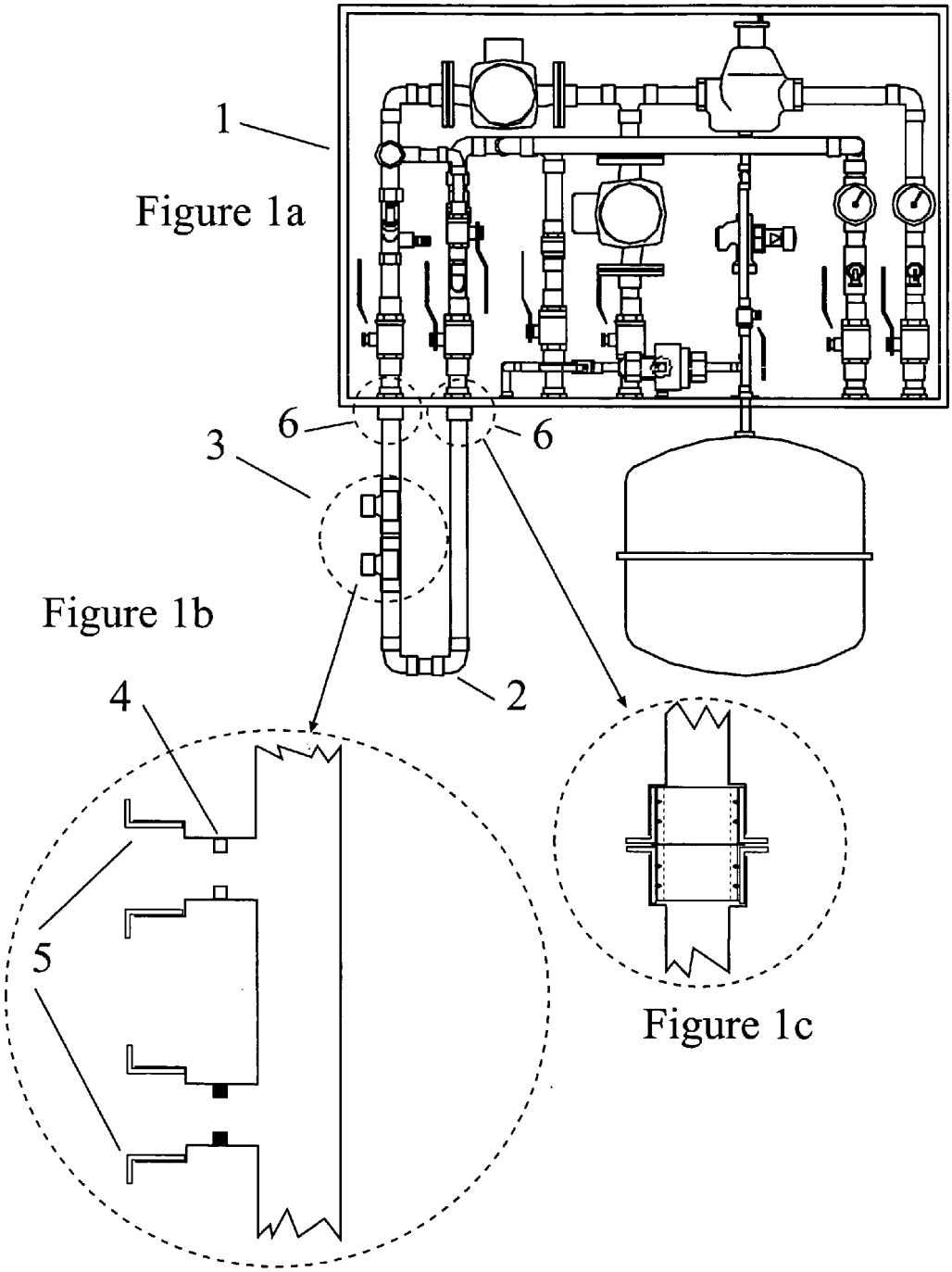
FIG. 1*a* shows a mechanical module with a connected transition adaptor.
FIG. 1*b* shows the branch connections on the transition adaptor.
FIG. 1*c* shows the main connections on the transition adaptor.

A transition adaptor 2 is shown in FIG. 1*a*, designed to facilitate connecting secondary component modules such as Pumping Component Modules, 3-Way Pumping Component Modules, Zone Control Component Modules, and Variable Speed Pumping Component Modules to preassembled intermediate component modules or primary loop component modules and or primary or secondary piping for hydronic heating systems.

FIG. 1*a* shows a typical preassembled mechanical module 1, in this case used in an intermediate position between a boiler, not shown, and the secondary component modules. The mechanical module may have any of the usual components (such as pumps, fill valve, expansion tank, air separator, isolation valves, check valves etc.). The mechanical module may be built to internally or externally include the transition adaptor 2 or may be built to accept the transition adaptor with specialized fittings as in one embodiment as shown at the transition fitting 6. If the transition adaptor 2 is integral to the preassembled hydronic mechanical module 1 and in an enclosure for the mechanical module, access to the secondary component module connectors 5 can be through holes of sufficient size made in the wall of the enclosure.

Figure 3:
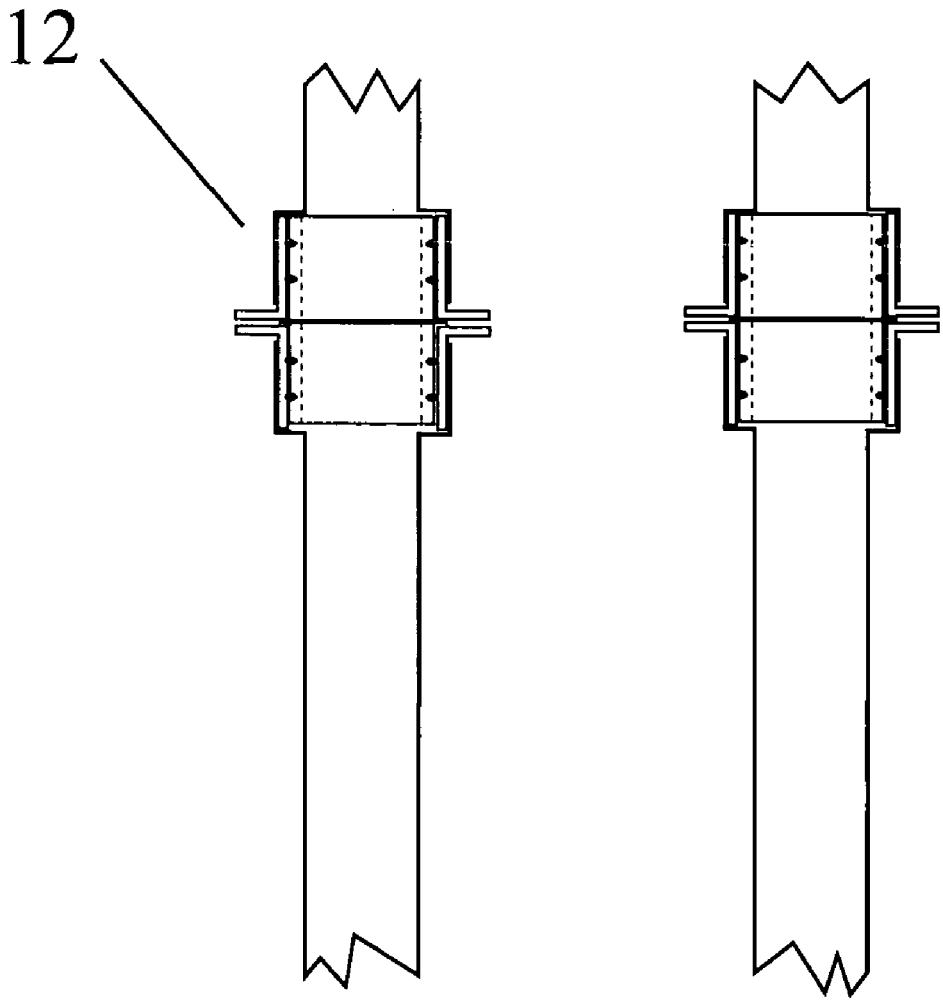
FIG. 3 shows the standard coupling in vertical orientation.

The transition adaptor may be built as a stand alone part as shown in FIG. 1*a* to be connected to the mechanical module with normal attachment methods such as unions or sweat fittings or with a specialized fitting connector as shown in one embodiment in FIG. 1*c* and FIG. 3. To maintain hydraulic separation, the branches off the main pipe that lead to the secondary components should be closely spaced together, limited only by needs for securing connections and securing the assembly to a mounting wall or other surface. The spacing should be no more than 4 pipe diameters, center to center. In one embodiment, the transition adaptor is made of 1½ inch diameter pipe, which sets a maximum distance of 6 inches. Two inches is a minimum distance for functioning of necessary fittings. Four inches is preferred for the embodiment made of 1½ inch diameter pipe.

Figure 2A:
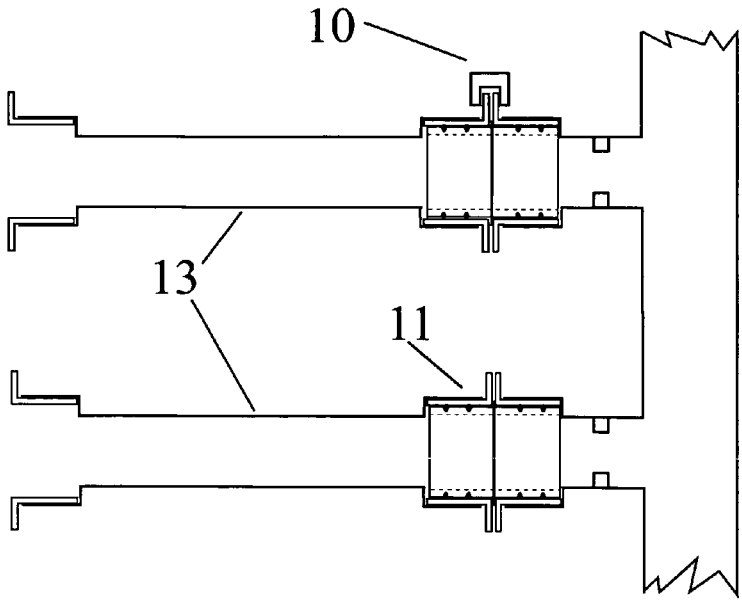
FIG. 2*a* shows standard length supply and return pipes coupled to a transition adaptor.
Figure 2B:
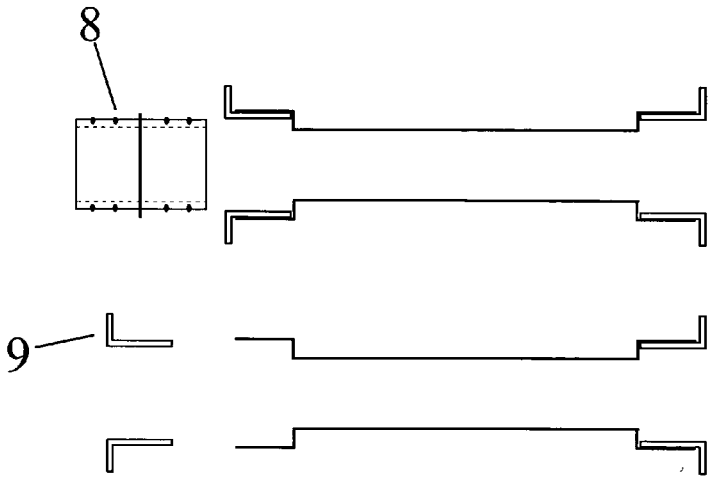
FIG. 2*b* shows coupling components for the supply and return pipes.

The transition adaptor secondary component module connectors 5 will provide a connection system compatible with systematically connecting secondary component modules such as Pumping Component Modules, 3 Way Pumping Component Modules, Zone Control Component Modules, and Variable Speed Pumping Component Modules. Such a connection system is shown in one embodiment in FIG. 2*b* with a flanged insert 9 brazed into the secondary component module connectors 5, which accepts a nipple with external "O" rings 8, which connects a secondary component module such as a pair of supply and return pipes 13 as shown in FIG. 2*a*. The flanges 9 may be retained with pins or with clips 10 as shown in FIG. 2*a*, clamps, screws or other means. The transition adaptor secondary component module connectors 5 may have an internal restriction or orifice 4 to improve hydraulic separation when used in primary/secondary piping systems.

Figure 8:
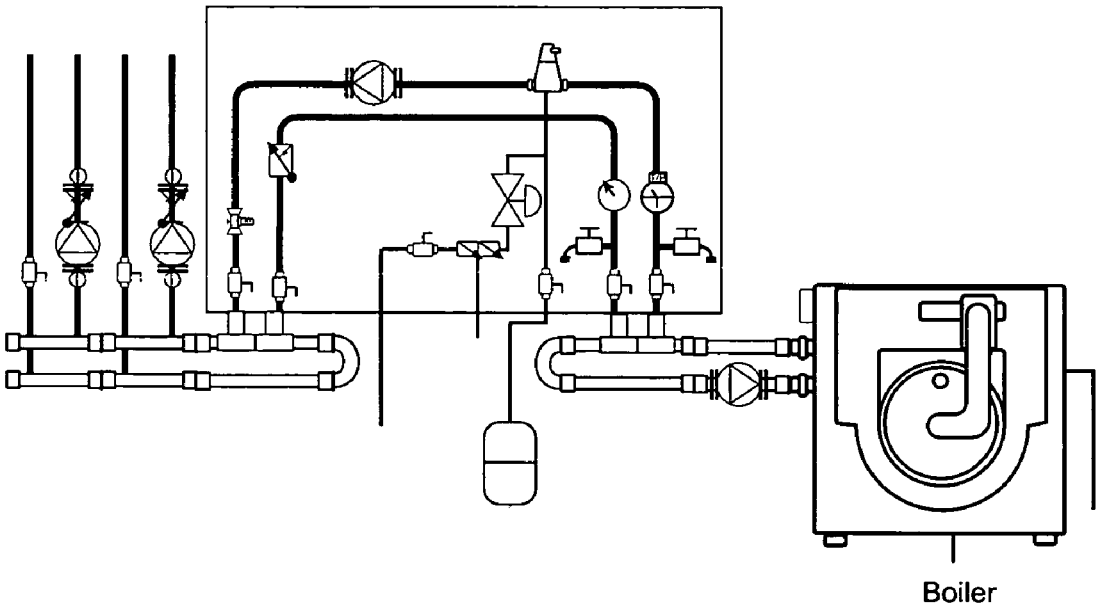
FIG. 8 shows use of the transition adaptor to complete a primary loop from a boiler as well as use of the transition adaptor in a horizontal position for completing an intermediate loop and making a transition to a third loop.
Figure 9:
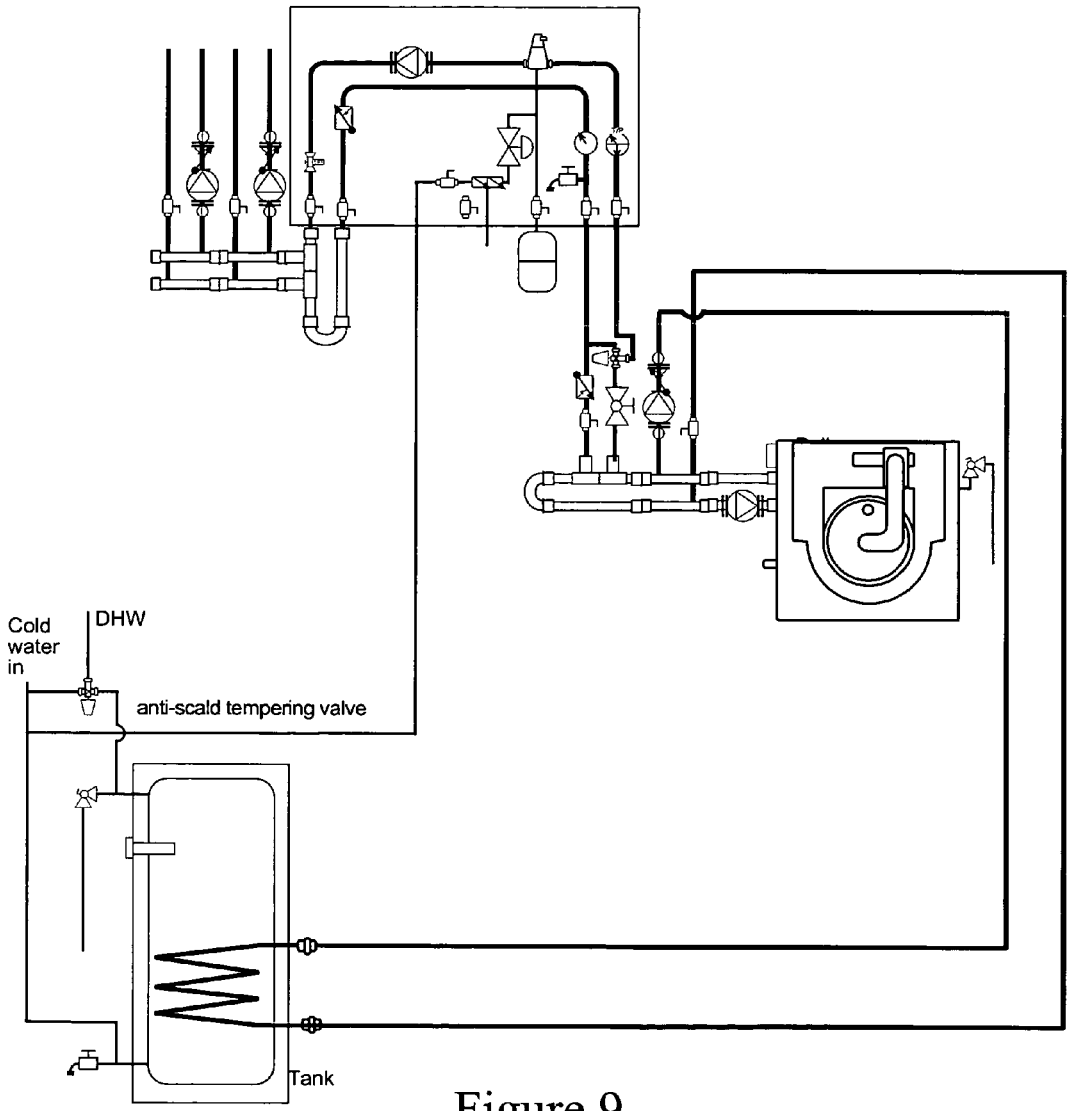
FIG. 9 shows a use of the transition adaptor to complete a primary loop off the boiler as well as a supply-return connector for supplying an indirect water tank.

Another use for a transition adaptor is shown in FIG. 8 where two transition adapters are used with an intermediate module. In this case the intermediate module contains a pump that functions as an injection pump. FIG. 9 shows another system where there are also two transition adapters, one forming a primary loop between a boiler and an intermediate component module, in this case using three-way mixing, and a second transition adapter forming a loop connecting to secondary component modules that pump to zones.

Figure 4:
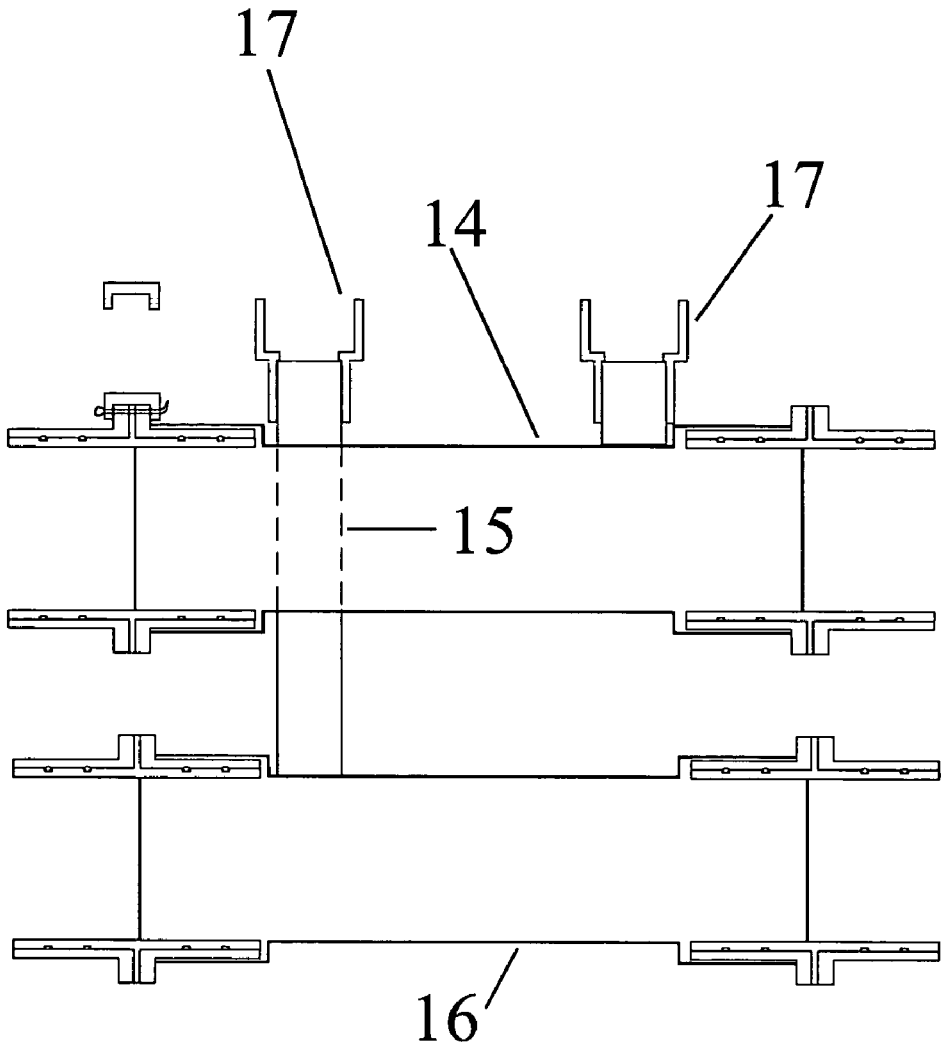
FIG. 4 shows the modular supply-return connector and its components.

FIG. 4 shows a supply-return connector with a main return pipe 16, a main supply pipe 14, a branch return inlet pipe 15 in fluid communication with the main return pipe 16 and going either around or through the main supply pipe 14. The branch pipe is severable at a connector 17 with a fitting, specialized or conventional. Other embodiments of the supply-return connector could have multiple return branch pipes through or around the main supply pipe or the configuration could be reversed with a branch supply pipe or pipes through or around the main return pipe. Another embodiment of the supply-return connector could combine the two approaches.

Modular secondary components may be attached at the branch connectors 17, normally pumps valves etc. Secondary module assemblies may be connected to the supply-return connector at that the branch inlet and outlet 17 with a fitting. Alternatively, the secondary component modules may include an integral supply-return connector as shown in FIGS. 5*a* and 5*b* where the 3 Way Component Module 19, Variable Speed Pumping Component Module 20, and Pumping Component Module 21 each include a supply-return connector. A secondary component module may also include a transition adaptor 2. Each secondary component module with an integral supply-return connector 19, 20 and 21 could have supply or return pipes going through or around the main supply or main return pipes.

A systematic assembly of these components is shown in FIG. 6*a*, showing the orderly benefits of using the transition adaptor with a preassembled mechanical module and secondary component modules since the possibility for poor piping practice and installer error is almost completely eliminated and installation time is vastly reduced. Since correct hydraulic separation is provided by the transition adaptor and component modules can be preassembled at the factory with the correct components, correct installation practice is almost completely assured. The transition adaptor and secondary component modules provide for the first time an integrated system for using preassembled mechanical modules and all the secondary distribution components. FIG. 6*a* shows the supply pipe sending hot fluid away from boiler 25 and the return pipe sending fluid back to the boiler 24.

FIG. 6*b* provides a key of symbols. The transition adaptor may be attached to a preassembled mechanical module at different points in the system than in the embodiments shown. When the transition adaptor is attached to the components normally in a preassembled mechanical module, whether or not those components are preassembled, the benefits of correct piping practice, hydraulic separation and ease of attaching primary, intermediate and secondary component modules provide the same benefits as when the transition adaptor is attached to or integral in a preassembled hydronic mechanical module.

Many other embodiments of preassembled hydronic mechanical modules and the applicable transition adaptor are possible. For example such a preassembled hydronic mechanical module might eliminate the connections for an indirect water tank or add a heat exchanger. In each case, the transition adaptor might be located in a different configuration or be of a different shape size and length. End Plugs 18, shown in FIG. 5*b*, can be made compatible with plugging the transition adaptor if not utilized, or for terminating main supply and return pipes of any of the secondary component modules and supply and return pipes on the Variable Speed Pumping Component Module.

Figure 7:
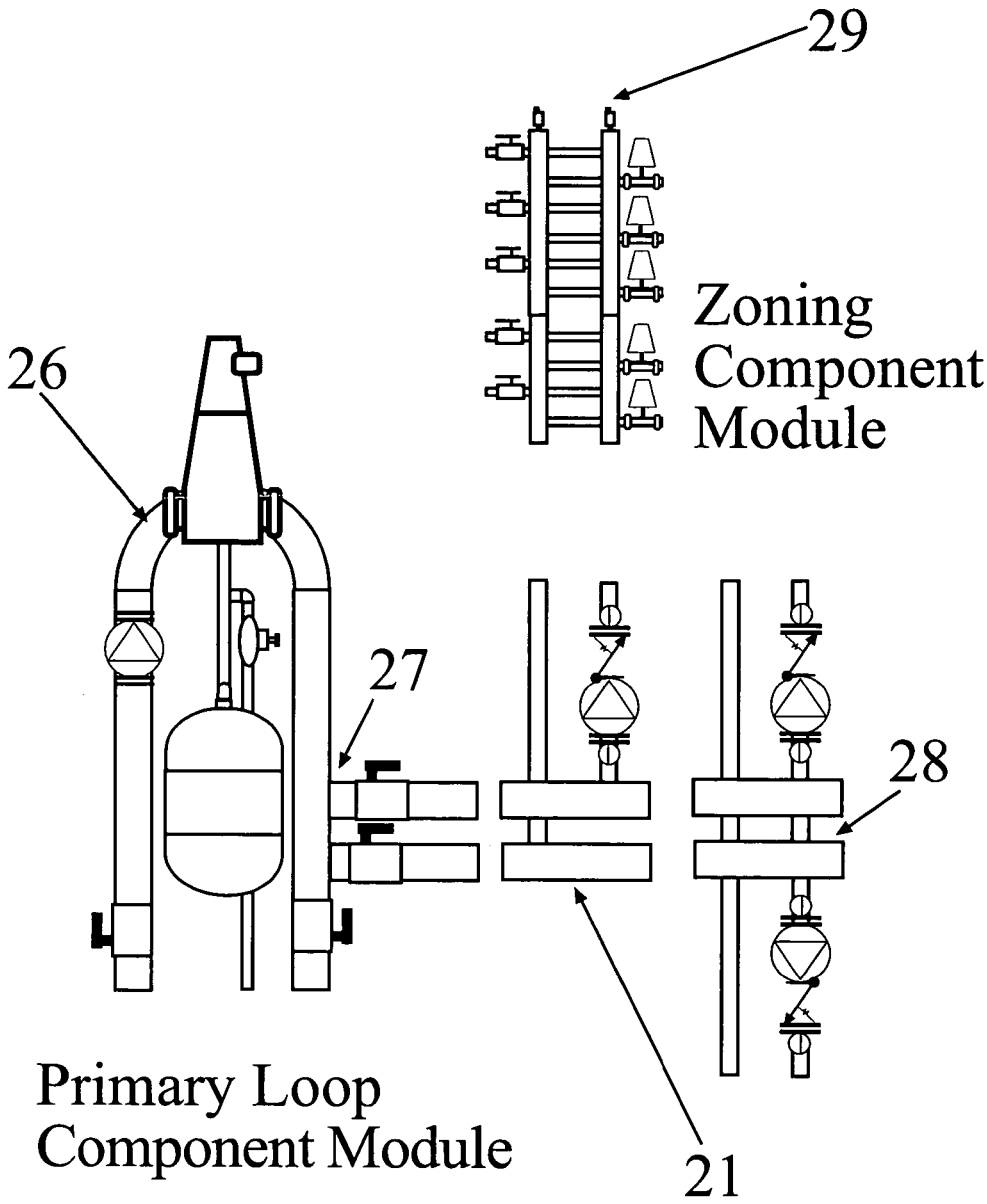
FIG. 7 shows a transition adaptor with additional components, a typical secondary component module, a secondary component module that serves as two primary loops, and a zoning component module.

FIG. 7 shows some different embodiments of the invention, showing in this embodiment a primary loop component module which contains or is connected to a transition adaptor 26 shown in this configuration also including isolation valves for the supply and return take off pipes. Illustration 7 also shows a Double Pumping Component Module 28 and a Zoning Component Module 29 that could be attached to any of the secondary component modules with a fitting method similar to those used in connecting the secondary component modules and/or the transition adaptor. One embodiment of such a system is shown in FIG. 3.

Secondary component modules could be made for any orientation and in combination of more than one unit. For example a Pumping Component Module might have one, two, three, four or more pumps and return pipes as part of the module. This invention consists of organizing the hydronic system into independent parts with standard connections having a standard relationship between the supply and return components so that these independent parts can be used in any systematic combination. Systematic spacing of component modules and use of a convenient systematic fitting system will enhance the ability to use preassembled mechanical module(s), transition adaptor(s) and the primary and secondary component modules together.

The transition adapter can also provide a systematic and convenient transition to and from field installed piping that is attached to any of the modular primary, secondary or intermediate component modules. The fitting systems as shown for example in 12, 10 and 11 could be male and female with an "O" ring insert on the male part instead of a nipple with "O" rings.

Since transition adapters and secondary component modules can be used in a system in different positions and orientations, numerous other embodiments are possible. FIG. 8 shows a transition adapter being used on the primary boiler loop and on a loop with secondary component modules, each transition adapter providing the transition to a mechanical module with an injection pump.

FIG. 9 shows a transition adapter being used on a boiler primary loop with a 3 way mixing module between the boiler primary loop and an intermediate mechanical module. Another transition adapter is shown completing the loop of the intermediate mechanical module and providing the transition to secondary component modules. A pumping component module is shown in FIG. 9 in position on the boiler primary loop to provide connections to and pumping to an indirect water tank.

Figure 10:
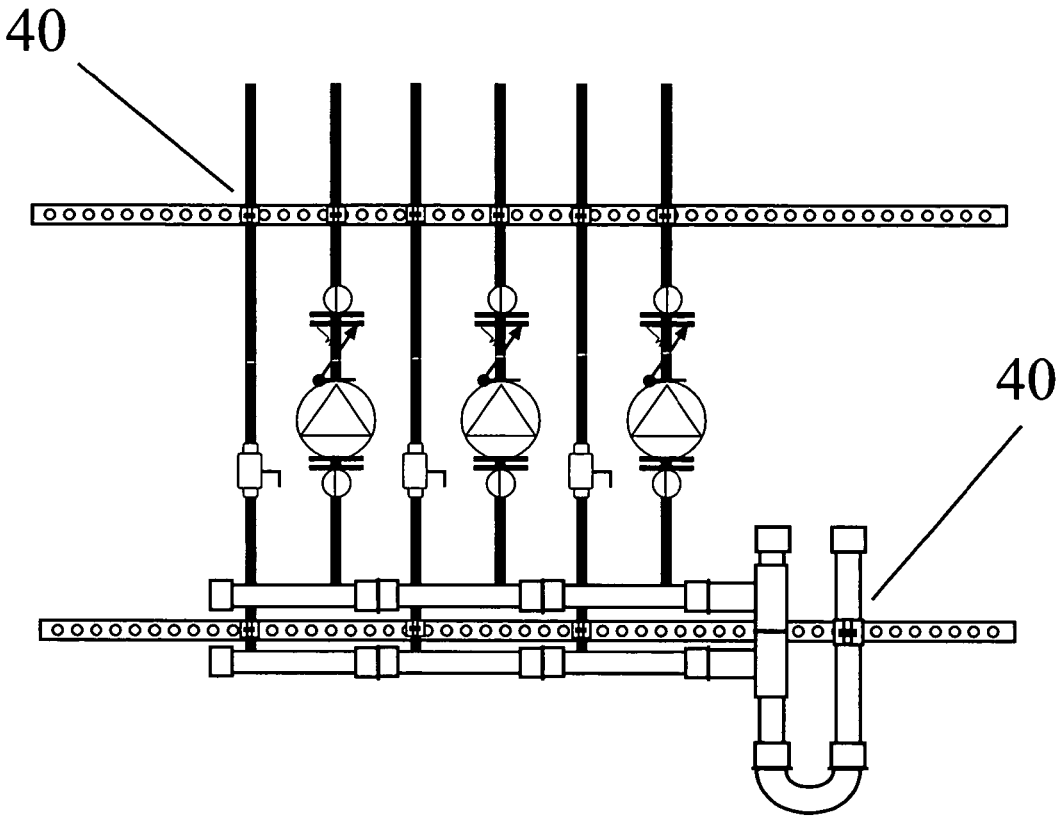
FIG. 10 shows how the component modules of the invented system can be mounted to a wall using standard clamping systems designed for use with standard pipe.

FIG. 10 shows component modules preassembled and mounted to strut supports or other conventional or nonconventional bracketing or supports. Clamps 40 or other connecters may be used to mount the component modules and transition adaptors, and, when properly made and placed, may be used to also retain or help retain the modules in place to prevent the modules from separating at the fittings. In this sense they become part of the modular component fitting assembly and no other clamp is required.

Although the present invention has been described in detail with reference to certain preferred embodiments, other embodiments are possible. Therefore, the spirit or scope of the appended claims should not be limited to the description of the embodiments contained herein. It is intended that the invention resides in the claims hereinafter appended.

What is claimed:

1. For use in hydronic heating systems, a modular transition adaptor, comprising:

a. a unitary component with no separable parts in the form of a main loop pipe, having a main inlet, a branch outlet, a branch inlet, and a main outlet, the inlets and outlets all having a nominal size in common; wherein:

b. the main inlet and the main outlet are side by side fixed in relation to each other and parallel to each other at a first set distance between them;

c. the branch outlet and the branch inlet are side by side fixed in relation to each other and parallel to each other at a second set distance between them which is equal to the first set distance; and d. each of the inlets and outlets has a connection fitting adapted to be fitted to another modular hydronic component.

2. The transition adaptor of claim 1 wherein each of the pairs of the main inlet and the main outlet and the branch outlet and the branch inlet are fixed in relation to each other at a center to center distance between them within a range of 2 inches to 12 inches.

3. The transition adaptor of claim 1 wherein each of the pairs of the main inlet and the main outlet and the branch inlet and the branch outlet are fixed in relation to each other at a center to center distance between them less than 4 pipe diameters.

4. The transition adaptor of claim 2 wherein each of the pairs of the main inlet and the main outlet and the branch inlet and the branch outlet are fixed in relation to each other at a center to center distance between them within a range of 2 inches to 6 inches.

5. The transition adaptor of claim 1 further comprising a pump between the main inlet and the main outlet.

6. The transition adaptor of claim 1 made of round metal pipes connected with melted and solidified metal.

7. A method of constructing a hydronic heating system having a primary loop with a heat source and a secondary loop serving a manifold to a plurality of heating loops, comprising:

a. receiving from one or more hydronic parts suppliers a plurality of component hydronic parts comprising:

1. one or more parts for constructing a primary loop, which primary loop will include a heat source and components to be coupled into the primary loop between the heat source and a manifold;

2. one or more parts for constructing a secondary loop, which secondary loop will include a manifold for a plurality of heating loops; and 3. a modular transition adaptor, consisting of a unitary component with no separable parts in the form of a main loop pipe, having a main inlet and a main outlet for coupling to the primary loop and a branch outlet and a branch inlet for coupling to the secondary loop, the inlets and outlets all having a nominal size in common, wherein:

A. the main inlet and the main outlet are side by side fixed in relation to each other and parallel to each other at a first set distance between them;

B. the branch outlet and the branch inlet are side by side fixed in relation to each other and parallel to each other at a second set distance between them which is equal to the first set distance; and C. each of the inlets and outlets has a connection fitting adapted to be fitted to another modular hydronic component; and b. coupling the secondary loop to the primary loop with the modular transition adaptor.

8. The method of claim 7 wherein each of the pairs of the main inlet and the main outlet and the branch inlet and the branch outlet of the transition adaptor are fixed in relation to each other at a center to center distance between them within a range of 2 inches to 12 inches.

9. The method of claim 7 wherein each of the pairs of the main inlet and the main outlet and the branch inlet and the branch outlet of the transition adaptor are fixed in relation to each other at a center to center distance between them less than 4 pipe diameters.

10. The method of claim 8 wherein each of the pairs of the main inlet and the main outlet and the branch inlet and the branch outlet of the transition adaptor are fixed in relation to each other at a center to center distance between them within a range of 2 inches to 6 inches.

11. The method of claim 7 wherein the transition adaptor further comprises a pump between the main inlet and the main outlet.

12. The method of claim 7 wherein the transition adaptor is made of round metal pipes connected with melted and solidified metal.

13. The method of claim 7 wherein the heat source is a boiler.

* * * * *